US005315902A

United States Patent [19]

Ragland et al.

[11] Patent Number: 5,315,902

[45] Date of Patent: May 31, 1994

[54] STUD REMOVING TOOL

[75] Inventors: Larry Ragland, Fort Worth; Emmitt Morales, Beaumont, both of Tex.

[73] Assignee: Gripping Tools Technologies, Inc., Fort Worth, Tex.

[21] Appl. No.: 980,672

[22] Filed: Nov. 24, 1992

[51] Int. Cl.[5] ..... B25B 13/50

[52] U.S. Cl. ..... 81/53.2; 81/128; 279/71

[58] Field of Search ..... 81/53.2, 54, 57.15, 81/57.17, 57.18, 57.21, 57.33, 128; 279/71, 114, 46.7

[56] References Cited

U.S. PATENT DOCUMENTS

| | | | |
|---|---|---|---|
| 2,580,247 | 12/1951 | Secondi et al. | 81/53 |
| 2,582,444 | 1/1952 | Lucht | 81/128 |
| 2,701,724 | 2/1955 | Harris | 279/71 |
| 2,962,291 | 11/1960 | Szlachetka | 279/114 |
| 3,371,562 | 3/1968 | Kelley | 81/54 |
| 4,713,990 | 12/1987 | Poling | 81/53.2 |
| 4,724,730 | 2/1988 | Mader et al. | 81/53.2 |
| 4,856,386 | 8/1989 | Rodriguez | 81/90 |
| 4,899,626 | 2/1990 | Lymburner | 81/53.2 |
| 4,932,292 | 6/1990 | Merrick | 81/57.18 |
| 5,152,195 | 10/1992 | Merrick | 81/53.2 |

*Primary Examiner*—D. S. Meislin

*Attorney, Agent, or Firm*—Arthur F. Zobal

[57] ABSTRACT

An improved stud removal tool comprises a cylindrical socket having an open end communicating with a coaxial cavity and a shank extending coaxially adjacent the socket opposite the open end, the shank terminating opposite the socket in an anvil end adapted to cooperate with a driver such as an impact wrench for turning the socket. A plurality of axially extending cams extend on the interior wall of the socket vary the radius of the cavity at evenly distributed positions. The cams radially engage an equal number of gripping jaws contained within a removable cartridge which is free to shift relative to the socket within the cavity. The cams thereby inwardly bias the jaws for gripping a stud inserted into the cavity between the jaws. The cartridge comprises a cylindrical unit made up of the jaws separated by resilient blocks bonded to the edges of the jaws and serving to space the jaws to keep them mated with the cams. The spacer blocks also radially bias the jaws outward against the cams.

16 Claims, 3 Drawing Sheets

STUD REMOVING TOOL

BACKGROUND OF THE INVENTION

1. Field of the Invention:

This invention relates to improvements to tools for tightening or non-destructive removal of threaded fasteners from objects, and particularly for removing studs protruding from objects sufficiently to grasp the studs about their circumference and to apply torquing force to rotate them. Still more particularly, this invention relates to sockets designed to axially surround the stud with gripping jaws which automatically contact the stud simultaneously in multiple locations about its circumference to apply thereto angular torque generated by a driver such as an impact wrench.

2. Description of Related Art:

Studs are lengths of rod threaded on one or both ends which serve as fasteners between objects in similar fashion to bolts. Unlike bolts, however, studs usually have no hexagonal head or other fixture adapted to cooperate with conventional wrenches for applying torque to the fixture to turn the bolt. Screwing or unscrewing threaded studs into or out of objects typically requires a tool adapted to apply angular torque to the axial perimeter of the stud at a point between the object and the end of the stud. Common hand tools adapted for the purpose include pipe wrenches which employ opposing toothed jaws to bite into the stud when angularly displacing an elongated, radially extending handle to apply angular force to the stud. Other hand tools, chucks or grapples employ different numbers of such jaws, three being the most common, radially forced against the stud using cams, as illustrated by U.S. Pat. No. 3,371,562.

Impact wrenches employing pneumatic pressure produce impulsed angular force to overcome frictional resistance to rotation of the stud. Sockets for use with impact wrenches commonly rely upon differential rotation between the socket and a vehicle bearing gripping jaws and carried within an axially aligned cavity in the socket. Cams on the cavity walls mate with outer curved surfaces of the jaws as the socket rotates to bias the jaws radially inward and into frictional contact with the outer perimeter of the stud. Teeth borne on the inner surface of the jaws bite into the stud to enhance the gripping effect of the frictional contact.

For various reasons, available sockets provide less than satisfactory performance of this function. For example, Merrick, U.S. Pat. Nos. 4,932,292 (Merrick I), and 5,152,195 (Merrick II), provide a plurality of jaws held within an open ended socket and biased outward against the cams by springs. Merrick I provides a positioning ring at one end of a trio of jaws, each of which has a lug protruding longitudinally into a radial slot within the ring. The positioning ring shifts with the jaws within the cavity to permit the radial slots to define and maintain balanced angular positioning of the jaws. Springs within the slots bear radially outward against the lugs to force open the jaws and to permit insertion of a stud into the cavity between the gripping surfaces of the jaws. Because of inevitable unbalanced tortional forces between each of the jaws, however, the lugs tend to shear off during rotational operation. This largely renders the tool inoperable because the jaws collapse inward and prevent insertion of a stud or fall out of place altogether.

Merrick II ostensibly offers an improvement by substituting for the positioning ring a hollow, cylindrical cage adapted to rotate with the jaws within the socket cavity. The cage carries one jaw within each of two opposing windows communicating through the cage walls. A resilient, circular wire forming a split-ring spring biases the jaws outward, the wire being carried in an annular groove longitudinally bifurcating the gripping surface of the jaws and the inner surface of the cage. If excess force is applied, however, such as where a stud is particularly hard to break out, the cage tends to continue its angular shift relative to the socket even after the jaws have gripped the stud and ceased shifting. This condition causes the jaws to slip out of the windows, further causing the cage to slip beneath one edge of the gripping surface of the jaws. This in turn applies radial force against the jaw, breaking either the jaw, the cage or both. A need therefore exists for a jaw configuration which will not break under adverse operating conditions and which has a reliable means to bias the jaws radially outward against the cams when not in use.

An additional problem of "bolt lock" arises with Merrick II and with any other such device employing one or more pairs of directly opposing jaws, especially where only two are present. The preferred method of loosening the jaws for removal of the socket from the stud is by simply reversing the torque applied by the driver. The cams thereby should reverse their angular shift relative to the jaws, increasing the radius of the socket walls at their contact with the jaws and decreasing the pressure applied until the gripping surface can slip on the stud. The biasing spring then fully retracts the jaws. When two opposing jaws lock into a grip on the stud, however, the radial forces applied by the cams directly oppose each other. This locks the cams to their bearing surface on the jaws, thereby locking the jaws to the stud and preventing loosening the jaws by reversing the torque. As reversing torque is applied, the tangential force in the socket walls at the cam contact point with the jaw is likely to cause the jaws to try to travel with the socket walls instead of causing the socket to turn relative to the jaws to relieve the pressure. If the jaws have shifted past this frictional "point of no return", reversing the torque only further forces the cam against the jaws, increasing the radial force against the jaws and the stud rather than decreasing it to permit the gripping surfaces to slip and unlock the grip. Giving the jaws a graduated thickness from one sidewall to the other helps deter bolt lock but does not prevent it, because sufficient thickness gradient to do so would create significant resultant tangential components to the biasing force of the cams, increasing shear forces applied to the stud and encouraging undesirable slippage of the teeth against the stud during operation. A large thickness gradient also requires unacceptably greater radial socket size to stud diameter. A need exists for a jaw configuration that functions effectively within a rotating socket without causing bolt lock.

Extraction of very large, heavy studs, such as those in the housing of turbine generators, often requires assistance of a crane to lift the studs using a sling or other device provided for the purpose. Likewise, the extraction tool for the job is heavy and, together with the driver, usually must be lifted into place using a crane. Field personnel have a tendency to use the extraction tool to lift the stud, however, without attaching the safety lifting sling. This creates a hazard that the jaws will spontaneously loosen and drop the stud, causing injury or damage. Such lifting is possible because radial forces tend to create significant friction between the cams and the jaws, even if the condition of bolt lock has not occurred. Nothing in the design of known socket jaw configurations prevents jostling from overcoming this friction and permitting the jaws to slip. A need therefore exists for a means of preventing reliance on the gripping surface to lift the stud.

SUMMARY OF THE INVENTION

Accordingly, it is an object of this invention to provide a jaw configuration to cooperate with a rotating socket which will not cause bolt lock.

It is another object of this invention to provide a reliable apparatus to bias the jaws radially outward to permit insertion of a stud into the socket and to prevent collapse of the jaws into the cavity.

It is another object of this invention to provide a means for keeping the jaws evenly spaced around the perimeter of the socket cavity.

It is yet another object of this invention to provide a means of preventing reliance upon the gripping surface of the jaws for lifting heavy studs.

The foregoing and other objects of this invention are achieved by providing an improved stud removal tool comprising a cylindrical socket having a coaxial cavity, and an open end communicating therewith, and a tubular shank extending coaxially adjacent the socket opposite the open end to an anvil end proximate and adapted to cooperate with a driver hammer for rotating the socket. A plurality of axially extending cams on the interior wall of the socket vary the radius of the cavity at evenly distributed positions. The cams radially engage bearing surfaces of an equal number of gripping jaws contained in a cartridge which is free to shift relative to the socket within the cavity. The cams thereby inwardly bias the jaws for gripping a stud inserted into the cavity between the jaws. The cartridge comprises a segmented cylindrical unit made up of a jaw for each cam, the jaws separated by resilient blocks bonded to the edges of the jaws and serving to axially space the jaws to remain mated with the cams. The spacer blocks also radially bias the jaws outward against the cams.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
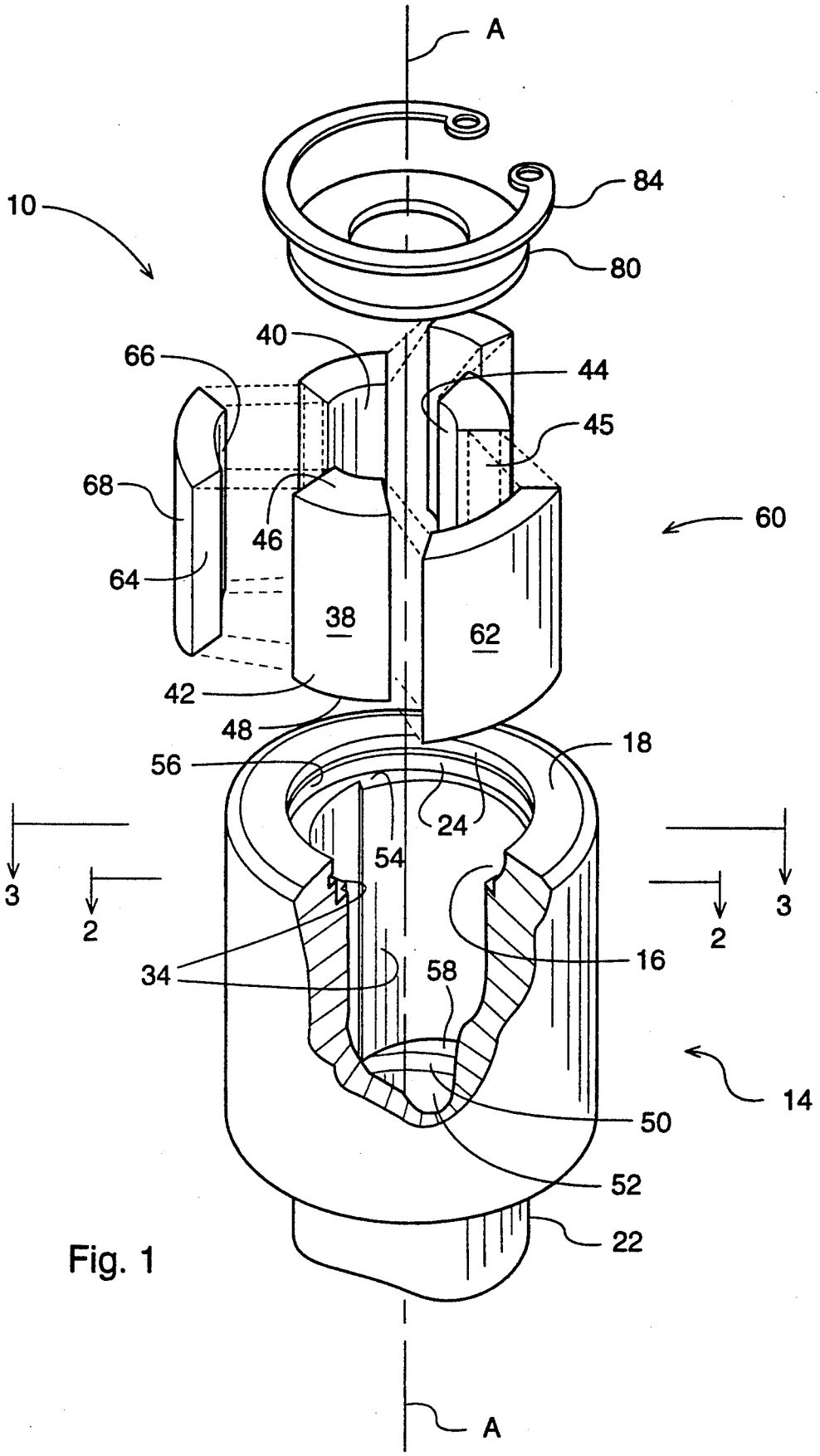
FIG. 1 depicts in axially exploded perspective of the tool of the present invention with the cartridge radially exploded to show its components.
Figure 5:
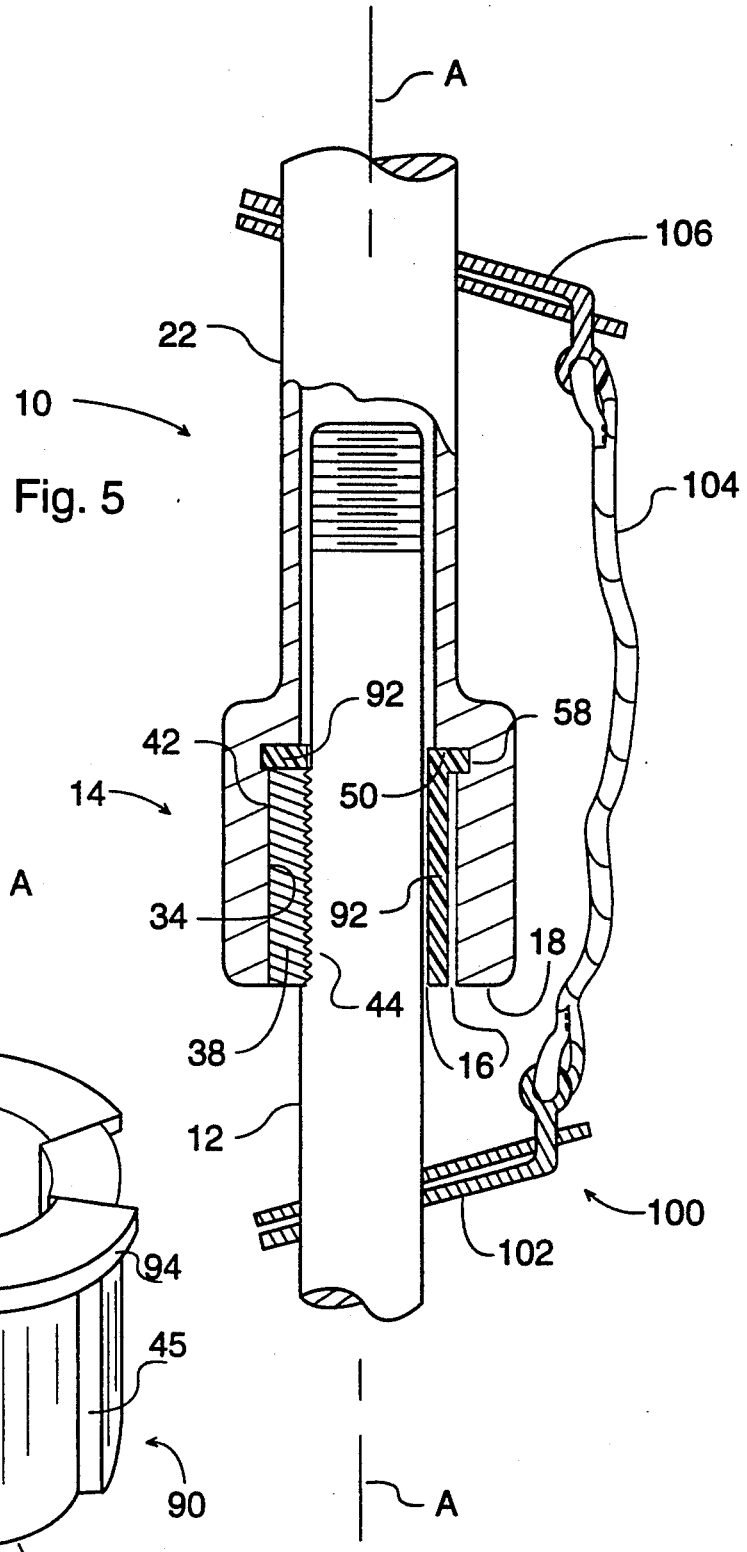
FIG. 5 shows in cutaway section the alternate embodiment of FIG. 4 in place in the cavity of the socket, and demonstrates a safety sling for lifting the stud.

With reference now to the figures, and in particular to FIGS. 1 and 5, the tool 10 of the present invention is shown to comprise a cupped socket housing 14 having longitudinal axis A and cylindrical, coaxial interior cavity 16 extending the longitudinal length of socket 14. One end 18 of socket 14 is open to permit access to cavity 16 by a stud 12. At the opposite end of cavity 16 a shelf 50 constricts the diameter of cavity 16, shelf 50 having an axial bore 52 extending into a hollow, tubular shank 22. Shank 22 extends coaxial with socket 14 adjacent shelf 50 and opposite open end 18 to terminate in an anvil end (not shown). The anvil end carries a commonly known driver adaptor means for cooperating with a driver such as an impact wrench for rotating shank 22 and socket 14.

Figure 2:
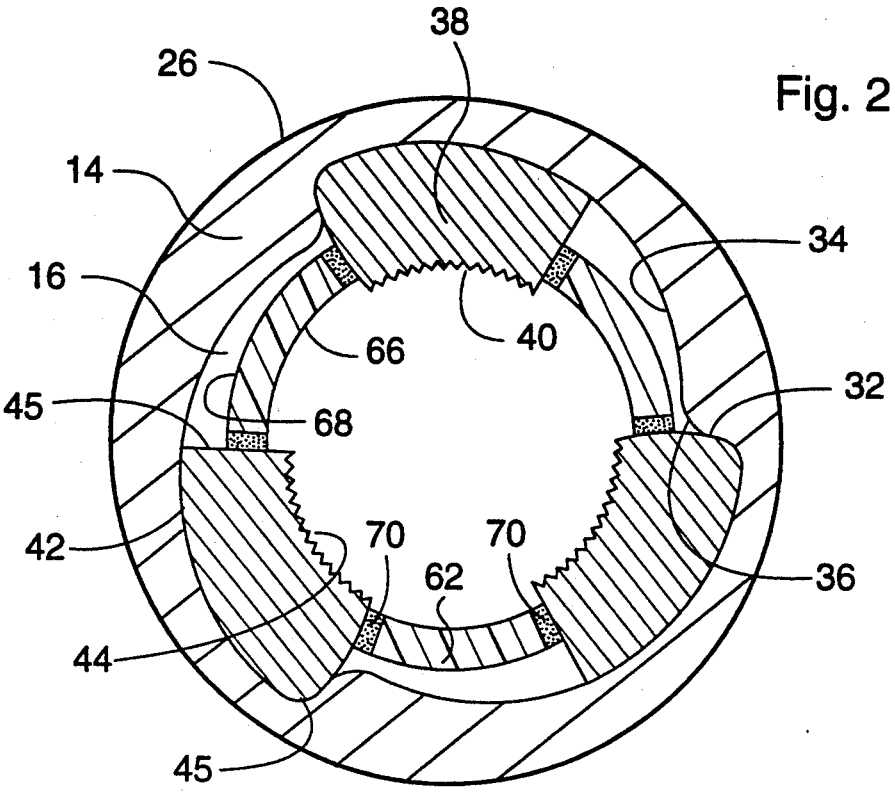
FIG. 2 shows a section of the tool looking axially from the open end and showing the jaws in fully retracted position.
Figure 3:
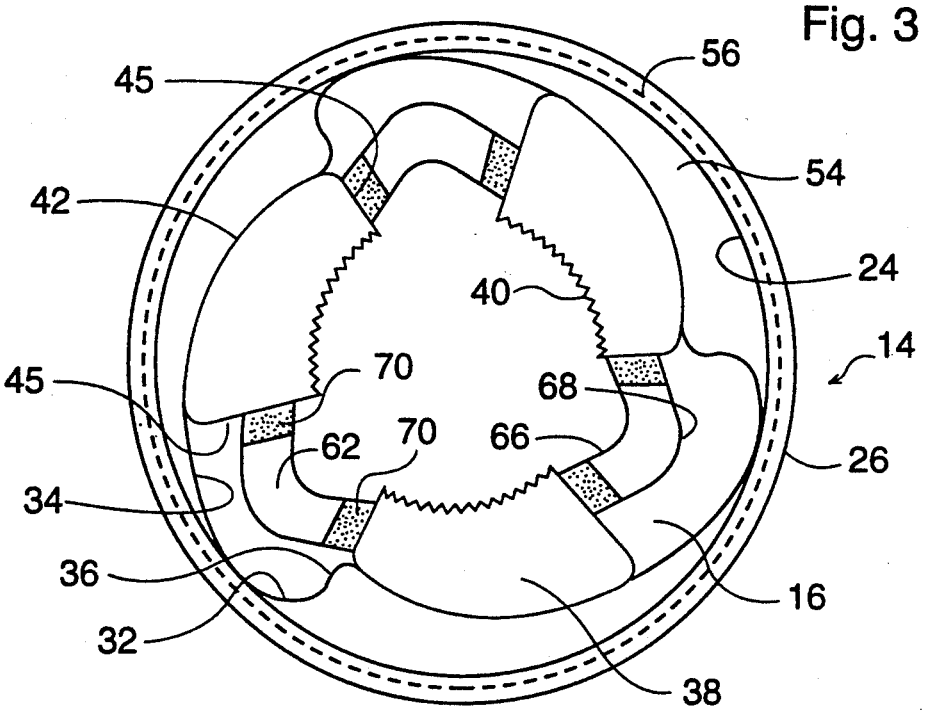
FIG. 3 again shows the view of FIG. 2 but from outside the open end and with the jaws biased inward toward the center of the cavity.

Cavity 16 includes a plurality of cams 34 extending parallel to axis A a substantial portion of the longitudinal length of socket 14. As illustrated in FIGS. 2 and 3, cams 34 cause the axial radius of cavity 16 to vary from a minimum where cam 34 is largest at its peak 36 to a maximum where cam 34 tapers to its smallest thickness immediately juxtaposed the face 32 of adjacent cam 34. Correspondingly, the thickness of perimeter walls 24 of socket 14 vary from a maximum where cams 34 are largest at their peaks 36 to a minimum where cams 34 are smallest immediately juxtaposed face 32 of adjacent cam 34. An annular recess 58 separates cams 34 from shelf 50.

Cams 34 longitudinally terminate opposite annular recess 58 and adjacent open end 18 in a plane normal to axis A, thereby defining ledge 54 extending radially away from axis A to the interior surface of perimeter wall 24 of socket 14. Washer 80 cooperates with perimeter wall 24 to rest against ledge 54, while retaining ring 84 cooperates with annular groove 56 to retain washer 80 against ledge 54, thereby retaining cartridge 60 within cavity 16.

Cartridge 60 comprises a generally cylindrical body made up of three jaws 38 separated by three spacer blocks 62 shown in radially exploded relative relationship in FIG. 1. Cartridge 60 rests upon shelf 50 and is thereby held within cavity 16 between bore 52 and open end 18 about axis A. As best seen in FIG. 2, jaws 38 and spacers 62 are arranged in alternating series around the interior perimeter of cavity 16.

Each jaw 38 has generally arcuate gripping surface 44 bearing teeth 40 for gripping the circumference of stud 12. Each jaw 38 further has generally arcuate bearing surface 42 opposite gripping surface 44 which mates with a cam 34. Bearing surface 42 and gripping surface 44 preferably are not coaxial, resulting in a thickness variation between substantially flat sidewalls 45. Notably, jaw 38 thickness is greatest where sidewall 45 abuts cam face 32 when jaws 38 are in the fully retracted position as illustrated in FIG. 2. Bearing surface 42, gripping surface 44 and sidewalls 45 define a generally wedge shaped cross section of a solid cylinder that is jaw 34. The thickness differential is chosen to assure that the resultant partial circumference created by gripping surfaces 44 is most nearly circular throughout the range of diameters presented by various angular shifts of cartridge 60 as jaws 38 travel between face 32 and peak 36 of cam 38. This in turn maximizes the radial component of the forces applied by cams 34 against bearing surfaces 42 most nearly to force teeth 40 radially into stud 12, thereby minimizing tangential components which would otherwise encourage slippage between jaws 34 and stud 12 during operation.

Spacers 62 comprise substantially planar blocks having a rectangular front 66 and matching back 68 and perpendicular sides 64. Spacers 62 have a side 64 width less than the radial width of either jaw sidewall 45, and spacers 62 mate centrally along sidewalls 45 between bearing surfaces 42 and gripping surfaces 44. When fully assembled, cartridge 60 forms a generally tubular cylinder because sidewalls 45 force spacers 62 to bend into a gentle arc between sidewalls 45, as best seen in FIG. 2.

Bonding regions 70 unite adjacent sidewalls 42 of jaws 38 to spacers 62. Bonding layer 70 is preferably achieved by vulcanizing of other process providing similar strength of attachment. One having ordinary skill in the art will recognize that other attachment means such as glue will work and are considered within the spirit and scope of the invention.

FIG. 3 illustrates the biasing spring capability of spacers 62. When jaws 34 are biased radially inward by cams 38, the effective circumference of cartridge 60 is reduced. This causes spacers 62 to flex and bow outward, storing compressive and moment energy in them. When the biasing force from cams 38 is removed, the elastic property of spacers 60 caused them to try to straighten out, forcing jaw bearing surfaces 42 to slide along cams 38 as far as permitted by cam face 32, thereby fully retracting jaws 34 from stud 12.

Spacers 62 preferably are fabricated from one of a group of materials known in the industry as elastic thermoplastic resins having the properties of durable resilience and resistance to petroleum products. Alternatively, any resilient elastic material such as rubber or neoprene which provides similar characteristics will serve the purpose, and one having ordinary skill in the art will recognize that all such qualifying materials are within the spirit and scope of the present invention.

In operation, tool is provided with cartridge 60 installed as shown in FIG. 2. Sidewalls 45 of jaws 38 rest adjacent cam faces 32, jaws 38 being in their fully retracted position, and spacers 62 extend between jaws 38 coaxial with cavity 16. Shank 22 is coupled to a driver (not shown) and stud 12 is inserted into cavity 16 between gripping faces 44 of jaws 38. Preferably, any threaded portion of stud 12 protrudes beyond shelf 50 into tubular shank 22 to avoid damage to the threads.

When the driver rotates tool 10, socket 14 shifts relative to cartridge 60, causing cams 34 to slide along bearing surfaces 42, as shown in FIG. 3, thereby shifting the portions of cams 34 in contact with bearing surfaces 42 to shift toward peak 36 until gripping surfaces 44 contact stud 12. As socket 14 continues to shift relative to cartridge 60, teeth 40 of gripping surfaces 44 bite into stud 12, enhancing friction between stud 12 and jaws 34 until friction stops socket 14 from further angular shift relative to jaws 34. At this point, the entire angular force from the driver is applied to stud 12, encouraging it to rotate in the same direction as socket 14. If sufficient to overcome friction holding stud 12 in the object (not shown), stud 12 will unscrew and can be removed from the object.

Obviously, if tool 10 is being used to tighten stud 12, torque will be applied until after friction stops rotation of stud 12 and thereby socket 14. Tightening stud 12 requires a socket having cams 34 arranged in opposite orientation to that required for removal, but the alternate socket can remove studs having reversed threads, and the same cartridge 60 will work in both types of sockets by simply turning cartridge 60 over and inserting the other end into the new socket.

After removal of stud 12 from an object, jaws 38 remain frictionally engaged with stud 12 until loosened, by hand or by reversing the driver rotation, by shifting socket 14 relative to cartridge 60. Using cartridge 60 retained by retaining ring 84 and washer 80, some lifting of stud 12 could be achieved by relying upon gripping surfaces 44. Since retaining ring 84 would bear the weight of stud 12 through washer 80, cartridge 60 would not slide out of socket 14. Further, friction between cartridge 60 and washer 80 would resist rotation of jaws 38 relative to cams 34, tending to deter retraction of jaws 38 which would release stud 12 to fall out of tool 10. This frictional locking of gripping surfaces 44 against stud 12 encourages the operator to rely upon this tool 10 to lift and relocate stud 12. This is a hazardous practice because the rotational force of the driver no longer is forcing cams 34 against bearing surfaces 42. Other that friction retarding movement of cartridge 60, the only continuing force on jaws 38 is the resiliency of spacers 62 biasing jaws 38 radially away from stud 12. If jostling dislodges jaw 38 from its frictional engagement from cam 34, it will slide toward face 32 under the pressure of spacer 62, disengaging gripping surfaces 44 from stud 12 and dropping it out of tool 10.

The operator may prevent stud 12 from causing injury or damage by securing safety lifting sling 100 to stud 12 to lift it along with tool 10. Cinching clamp 102 grips stud 12 below tool 10 under tension from tether 104, tether 104 being secured (not shown) to tool 10 or other convenient lifting mechanism. Sling 100 is released from stud 12 and tool 10 is brought back to the extraction site (not shown) for removal of another stud 12. Unfortunately, it is common practice to forego using sling 100, thereby risking the hazard.

Figure 4:
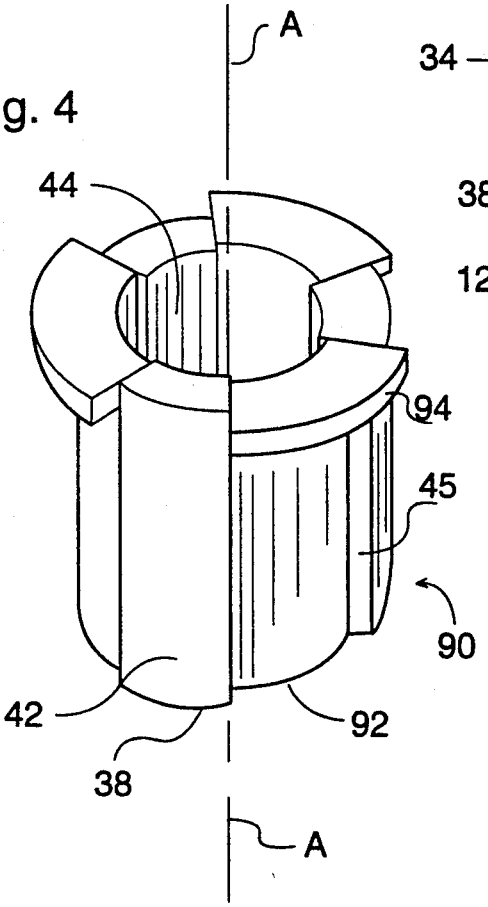
FIG. 4 shows an alternate embodiment of the cartridge wherein a flange protrudes radially outward from one end of the spacers.

Alternate cartridge 90 prevents lifting stud 12 by using tool 10. As seen in FIG. 1 and discussed above, retaining ring 84 and washer 80 cooperate with ledge 54 to comprise means for retaining cartridge 60 inside cavity 16. FIGS. 4 and 5 disclose alternative retaining means. Flange 94 extends radially outward from one end of each alternate spacer block 92 in a plane normal to axis A. Flange 94 is an integral part of spacer block 92 and embodies similar resiliency add flexibility. As seen in FIG. 5, flange 94 cooperates with annular recess 58 to retain cartridge 90 within cavity 16. Retaining ring 84 and washer 80 are absent from open end 18 and cams 34, jaws 38 and spacer blocks 92 extend closer to opening 18. This latter feature also permits grasping shorter studs 12 with jaws 34 than would be possible with socket 14 employing retainer ring 84 and washer 80. Should axial force be applied to cartridge 90, flanges 94 will flex and withdraw from recess 58, permitting cartridge 90 to slide out open end 18 rather than lifting stud 12. Thus, the operator is forced to use sling 100 to lift stud 12 by shank 22 of tool 10, or to find alternate means to lift stud 12.

While the invention has been particularly shown and described with reference to a preferred embodiment, it will be understood by those skilled in the art that various changes in form and detail may be made therein without departing from the spirit and scope of the invention. For example, spacers 62 need not be composed entirely of resilient material, but could be rigid for a substantial portion of their width as long as some resilient, cushioning material buffers the contact between spacers 62 and sidewalls 45. The radially outward biasing of spacers 62 would then come from the cushioning means between spacers 62 and sidewalls 45. Sufficient cushioning means must be left to permit constriction of cartridge 60 while gripping stud 12. Also, tool 10 could employ two or more jaws 38 and mating cams 34 spaced evenly within cavity 16 and is not limited to sets of three as illustrated and discussed. Obviously, a corresponding number of spacers would be required.

I claim:

1. A stud removal tool comprising a cylindrical socket having a longitudinal axis, an axial cavity extending substantially the longitudinal length of the socket between an open end and a shank end, the cavity being adapted to receive, by way of the open end, a stud to be removed, the cavity having a perimeter wall defining an interior surface of the socket, and a shelf adjacent at the shank end having an axial bore communicating between the cavity and the shank end;

a plurality of cams integral with the wall of the socket, the cams being spaced in series around the perimeter wall of the cavity;

a shank coaxial with the socket and extending adjacent the shelf and opposite the open end, the shank having an axial bore communicating with the cavity through the shank end for receiving an extension of a stud from the cavity when located therein, the shank further having an end to be coupled to a rotational driver for rotating the socket;

a cartridge adapted to be received within the cavity and having a plurality of jaws extending around the axis when located in the cavity, each jaw having an outer bearing surface for engaging one of the cams, an arcuate inner gripping surface and opposite ends with side walls to define a wedge-shaped cross section of each jaw, the jaws being spaced around the interior surface by a plurality of spacer means each of which comprises resilient means; each of said spacer means being secured to a sidewall of one of said jaws and to the closest sidewall of the next jaw of said cartridge for holding said jaws together for forming said cartridge;

retaining means for retaining the cartridge inside the cavity between said open end and said shelf.

2. The stud removal tool according to claim 1 wherein the spacer means comprises resilient blocks equal in number to the jaws, each block having inner and outer surfaces coaxial with the cavity and radial sides bonded to the side walls of the jaws.

3. The stud removal tool according to claim 2 wherein the retaining means comprises an annular recess formed in said perimeter wall between the cams and the shelf, a flange integral with a shank end of each block and extending radially outward from its outer surface, the flange adapted to cooperate with the annular recess between the cams and the shelf.

4. The stud removal tool according to claim 1 wherein the retaining means comprises an annular ledge coaxial with the socket a spaced distance interior the cavity between the open end and the cartridge, the ledge having a minimum radius;

a washer having a coaxial bore and an outer radius larger than the minimum radius and smaller than the radius of the perimeter wall, the washer being adapted to be received within the cavity between the open end and the ledge; and a resilient retainer ring adapted to removably cooperate with an annular groove in the perimeter wall of the socket immediately interior the open end between the open end and the washer.

5. The stud removal tool according to claim 1 wherein the spacer means comprises rigid blocks equal in number to the jaws and extending a substantial portion of the axial length of the jaws, each block having inner and outer surfaces coaxial with the cavity wall and radial sides adjacent the side walls of the jaws; and a resilient cushion means between each side wall of the jaws and the side of the adjacent block, the cushion means being bonded to the jaws and the blocks.

6. An improved stud removal tool, the took having a cylindrical socket, an exterior, an open first end, a second end opposite the first end and an interior cavity having a perimeter wall coaxial with the socket and having an axis, the cavity communicating with the exterior at the first end and partially closed by a shelf adjacent the second end, the cavity being adapted to receive, by way of the open end, a stud to be removed, the shelf having an axial bore communicating through the second end into an axial bore of a shank for receiving an extension of a stud from the cavity when located therein, the shank extending coaxial with the socket to an end to be coupled to a driver for rotating the socket, the socket further having a plurality of cams extending between the first and second ends and spaced around the perimeter wall, the improvement comprising a cartridge adapted to be received within the cavity and having a plurality of jaws extending around the axis when located in the cavity, each jaw having an outer bearing surface for engaging one of the cams, an inner gripping surface and opposite ends having side walls to define a wedge-shaped cross section of each jaw;

resilient spacer blocks equal in number to the jaws and extending a substantial portion of the axial length of the jaws, each block having inner and outer surfaces coaxial with the cavity wall and side walls bonded to the side walls of the jaws; and retaining means for retaining the cartridge inside the cavity between said open end and said shelf.

7. The stud removal tool according to claim 6 wherein the retaining means comprises an annular ledge coaxial with the socket a spaced distance interior the cavity between the open end and the cartridge, the ledge having a minimum radius;

a washer having a coaxial bore and an outer radius larger than the minimum radius, the washer adapted to be received within the cavity between the open end and the ledge; and a resilient retainer ring adapted to removably cooperate with an annular groove in the perimeter wall of the socket immediately interior the open end between the open end and the washer.

8. The stud removal tool according to claim 6 wherein the retaining means comprises an annular recess formed in said perimeter wall between the cams and the shelf, a flange integral with a shank end of each block and extending radially outward from its outer surface, the flange adapted to cooperate with the annular recess between the cams and the shelf.

9. A tool for removing a threaded member, comprising:

a socket having an open end and an opposite end with a cavity communicating with said open end for receiving a threaded member to be removed, said cavity having a central axis extending between said open end and said opposite end and a perimeter wall defining an interior surface extending around said axis, holding means next to said opposite end of said socket, a plurality of cams integral with said perimeter wall and spaced apart around said perimeter wall, support means coupled to said opposite end of said socket for use for rotating said socket, a cartridge comprising an annular member having a plurality of spaced apart jaws adapted to be located in said cavity with said jaws extending around said axis, each jaw having an outer bearing surface for engaging one of said cams, an arcuate inner gripping surface for gripping the threaded member to be removed and opposite ends with side walls, said jaws being spaced apart by a plurality of spacer means each of which comprises resilient means, each spacer means being secured to a sidewall of one of said jaws and to the closest sidewall of the next jaw of said annular member for holding said jaws together for forming said cartridge, and retaining means for retaining said cartridge inside said cavity between said open and said holding means.

10. The tool of claim 9, wherein each spacer means comprises a resilient member having opposite ends secured to the sidewall of one of said jaws and to the closest sidewall of the next jaw of said annular member.

11. The tool of claim 9, wherein each spacer means comprises a rigid member with opposite ends and a resilient cushion means secured to each end of said rigid member with one resilient cushion means secured to the sidewall of one of said jaws and the other of said resilient cushion means secured to the closest sidewall of the next jaw of said annular member.

12. The tool of claim 9 wherein the retaining means comprises:

an annular ledge coaxial with the socket a spaced distance interior the cavity between the open end and the cartridge, the ledge having a minimum radius;

a washer having a coaxial bore and an outer radius larger than the minimum radius and smaller than the radius of the perimeter wall, the washer being adapted to be received within the cavity between the open end and the ledge; and a resilient retainer ring adapted to removably cooperate with an annular groove in the perimeter wall of the socket immediately interior the open end between the open end and the washer.

13. The tool of claim 9 wherein the retaining means comprises:

an annular recess formed in said perimeter wall between the cams and the holding means, a flange integral with a shank end of each block and extending radially outward from its outer surface, the flange adapted to cooperate with the annular recess between the cams and the holding means.

14. The tool of claim 9 wherein said support means comprises:

a shank coupled to said opposite end of said socket and having an end to be coupled to a driver for rotating said socket.

15. The tool of claim 14 wherein said shank has an axial bore communicating with said cavity for receiving an extension of a threaded member to be removed and extending from said cavity when located therein.

16. The tool of claim 9 wherein said cartridge including said jaws and spacer means is locatable into and removable from said cavity as a single unit.

* * * * *